US005402873A

United States Patent [19]

Ibarrola et al.

[11] Patent Number: 5,402,873

[45] Date of Patent: Apr. 4, 1995

[54] COIN SELECTOR

[75] Inventors: Jesûs E. Ibarrola; José L. P. Insausti, both of Pamplona, Spain

[73] Assignee: Azkoyen Industrial, S.A., Peralta, Spain

[21] Appl. No.: 74,762

[22] Filed: Jun. 11, 1993

[30] Foreign Application Priority Data

Jun. 12, 1992 [ES] Spain ..... 9201227

[51] Int. Cl.[6] ..... G07D 5/08

[52] U.S. Cl. ..... 194/308

[58] Field of Search ..... 194/307, 308, 309, 331

[56] References Cited

U.S. PATENT DOCUMENTS

| | | | |
|---|---|---|---|
| 884,441 | 4/1908 | Weser | 194/308 |
| 1,625,979 | 4/1927 | Brinkerhoff . | |
| 1,910,963 | 5/1933 | Polsen et al. | 194/308 |
| 3,169,626 | 2/1965 | Miyagawa et al. | 194/317 |
| 3,415,256 | 12/1968 | Meloni . | |
| 3,712,441 | 1/1973 | Taylor . | |
| 3,878,711 | 4/1975 | Randolph . | |
| 4,089,400 | 5/1978 | Gregory | 194/331 X |
| 4,105,105 | 8/1978 | Braum . | |
| 4,263,924 | 4/1981 | Johnson . | |
| 4,503,961 | 3/1985 | Chittleborough . | |
| 4,650,057 | 3/1987 | Koester . | |
| 4,690,263 | 9/1987 | Yokomori . | |
| 4,893,706 | 1/1990 | Ibarrola . | |
| 5,063,518 | 11/1991 | Chitty et al. . | |
| 5,067,604 | 11/1991 | Metcalf . | |
| 5,085,309 | 2/1992 | Adamson et al. . | |

FOREIGN PATENT DOCUMENTS

| | | |
|---|---|---|
| 0000010 | 12/1978 | European Pat. Off. . |
| 0184393 | 6/1986 | European Pat. Off. . |
| 0246993 | 11/1987 | European Pat. Off. . |
| 0323396 | 7/1989 | European Pat. Off. . |
| 0360506 | 3/1990 | European Pat. Off. . |
| 747958 | 6/1933 | France . |
| 2293749 | 7/1976 | France . |
| 603120 | 9/1934 | Germany . |
| 2825094 | 12/1979 | Germany . |
| 3009466 | 9/1981 | Germany . |
| 3512579 | 10/1986 | Germany . |
| 549841 | 12/1985 | Spain . |
| 555181 | 5/1986 | Spain . |
| 11006 | of 1892 | United Kingdom . |
| 727581 | 4/1955 | United Kingdom . |
| 1066389 | 4/1967 | United Kingdom . |
| 1486519 | 9/1977 | United Kingdom . |
| 2022897 | 12/1979 | United Kingdom . |
| 2047936 | 12/1980 | United Kingdom . |
| 2070307 | 9/1981 | United Kingdom . |
| 2105893 | 3/1983 | United Kingdom . |
| 2135094 | 8/1984 | United Kingdom . |
| 8300400 | 2/1983 | WIPO . |

*Primary Examiner*—F. J. Bartuska

*Attorney, Agent, or Firm*—Rothwell, Figg, Ernest & Kurz

[57] ABSTRACT

Coin selector, which defines a route or path for the coins, along which are fitted optical and/or electromagnetic sensors, as well as means for detecting the electrically insulating or conducting nature of the rim of the coins introduced. These means consist of two electrical contacts, one fixed (2) and the other mobile (1), between which pass the coins (3) introduced, these contacts forming part of a detection circuit (4).

3 Claims, 1 Drawing Sheet

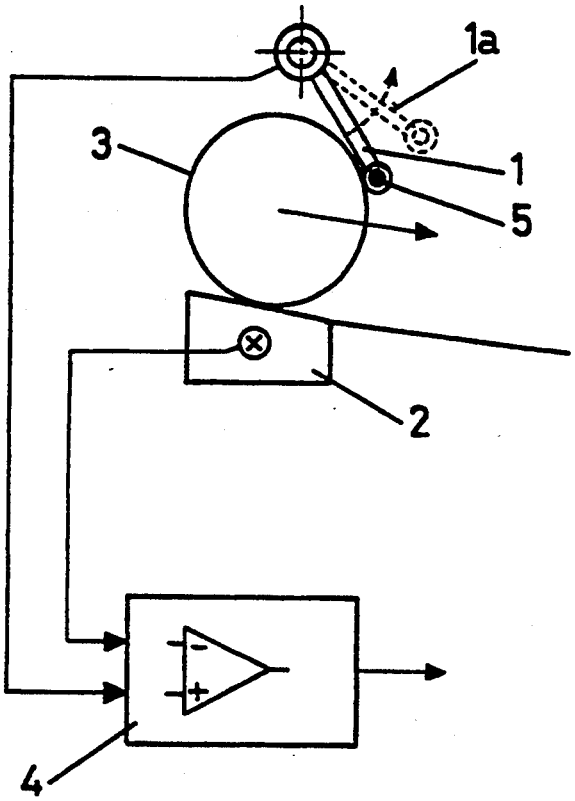
1a
3
1
5
2
4

COIN SELECTOR

FIELD OF THE INVENTION

This invention concerns a coin selector, especially applicable to machines that are put into operation by means of introducing one or more coins.

DESCRIPTION OF RELEVANT ART

The fundamental purpose of coin selectors is to detect whether or not the coins that are introduced are valid, rejecting those that are not valid and accepting valid coins once their value is known.

Coin selectors are already known that define a route or path for the coins, along which are fitted detection means that allow the validity and value of the coins to be known. These means can consist of optical detectors, based on phototransistors for example, and/or electromagnetic detectors based on coils.

Selectors with the design mentioned above are described in, for example, Spanish patents numbers 557.523 and 555.181 from the same applicants.

Coin selectors are also known that furthermore include in the path of the coins at least one rocker arm located towards the entrance to that path, a second rocker arm being able to be fitted towards the exit from it. These rocker arms consist of a freely rotating lever which swings as each coin passes, directing them along the appropriate route in order to follow the path defined in the selector. As an example of selectors with rocker arms of this type, the Spanish industrial model 112.362 from the same applicant can be mentioned.

Nevertheless, with selectors of the type described, it can be difficult to detect the introduction of a false coin consisting of a metal disc made out of an alloy similar or identical to that of the valid coin but with a diameter less than that of the valid coin and which might have a peripheral hoop of plastic material fitted around its rim, with which a final diameter identical to that of the valid coin would be achieved without altering the metallic characteristics of the disc or coin used.

This case actually happens, using as the base disc coins of the same country or other countries which have a value and diameter less than that of the coins accepted as valid by the selector, but made out of an equal or similar alloy. Fitted to these coins is a hoop of plastic material which, without altering the characteristics of the coin's alloy, allows the desired diameter to be achieved.

SUMMARY OF THE INVENTION

The subject of the present invention concerns a coin selector of the type described above, which has the means for detecting coins that have been falsified by the addition of a plastic hoop in the manner already mentioned, in such a way that the selector will offer the maximum security against the possible use of non-valid coins.

In accordance with this invention, as well as the traditional detection systems already described, the selector has the means for detecting the electrically insulating or conducting nature of the rim of coins introduced. These means consist of two electrical contacts, one fixed and the other mobile, between which pass the introduced coins. The mobile contact is freely displaceable from a stable rest position, in which it is located at a distance from the fixed contact that is less than the diameter of the smallest coins that can be accepted by the selector, up to an unstable activation position towards which the mobile contact is pushed by the passage of each coin introduced into the selector.

The two contacts mentioned form part of a detection circuit which closes via these contacts when a coin passes between them having a rim with an electrically conducting nature.

The mobile contact can consist of a freely swinging lever that intercepts the path of the coins close to the entrance of the path, while the fixed contact can consist of a metal piece defining the rolling route for the coins.

The lever defining the mobile contact can consist of the rocker arm located towards the entrance to the route or path of the coins. In this case, the rocker arm will have a metallic nature and be connected to the detection circuit, as is the metal piece defining the rolling route for the coins.

DESCRIPTION OF THE DRAWINGS

A more detailed description of the selector of the invention is made below, with the help of the attached diagram, which in schematic form shows one possible design of the means for detecting the insulating or conducting nature of the rim of coins introduced into the selector.

DESCRIPTION OF THE DRAWINGS

As already stated, the detecting means consist of two electrical contacts, one fixed and the other mobile. In the attached diagram reference number 1 indicates a swinging lever with a metallic nature, which will constitute the mobile contact, while reference number 2 indicates a fixed metal piece that will define the rolling route for the coins 3 introduced into the selector and which will define the fixed contact.

The lever 1 and the fixed metal piece 2 are connected to a detection circuit 4.

The lever 1 can swing freely between a stable rest position, represented by solid lines in the diagram, and an unstable activation position, represented by broken lines and referenced with number 1*a* in the diagram. The distance between the rocker arm 1 in its rest position and the metal piece 2 will be less than the diameter of the smallest coin 3 that can be accepted by the selector.

In this way, once a coin 3 is introduced into the selector, it passes between the lever 1 and the metal piece 2. The coin 3 rests by its rim on the metal piece 2 and also on the head or arm end 5, having a metallic nature, of the lever 1. If the rim of the coin 5 is metallic it will close the detection circuit 4, while if it is electrically insulating it will not cause this circuit to close.

In the case of the introduced coin 3 consisting of a metal disc made of an alloy equal or similar to that of a valid coin, but of smaller diameter and including a fitted peripheral hoop of plastic material in order to achieve the diameter corresponding to the valid coin, closure of the circuit 4 will not take place since the rim of the coin will have an electrically insulating nature. If the introduced coin is legal tender and corresponds to the size and value that can be accepted by the selector, its rim will close the circuit 4 when it is resting on the fixed metal piece 2 and on the lever 1.

The fixed contact 2 can consist of the metal anvil included in coin selectors for cushioning the fall of coins introduced. For its party the lever 1 can be constituted by the rocker arm responsible for directing the coins introduced into the selector and located towards the entrance to the path or route for them, this rocker arm being given an electrically conducting nature.

We claim:

1. For use in a coin selector apparatus including a route along which an inserted coin travels which route is located near sensors for detecting the validity and value of the inserted coin, a device for detecting whether the rim of a coin is formed of a material that is a conductor or insulator of electricity, said detecting device comprising:

first and second electrical contacts defining a space therebetween for accepting different size coins introduced therein, the first contact having a fixed position and the second contact moving from a rest position in a direction away from the first contact in response to movement of one of said different size coins between said contacts, wherein at said rest position the second contact is spaced from the first contact a distance that is less than the diameter of the smallest size coin which said device can detect whether the material forming the rim thereof is a conductor or insulator, wherein said first and second contacts form part of a detection circuit which is closed when a coin having a rim of an electrically conducting nature passes between said contacts.

2. The detecting device according to claim 1, wherein the movable contact includes a swinging lever formed of a metallic material which intercepts the coin introduced between the contacts, and the fixed contact includes a metal piece that at least partially defines a path for the introduced coin.

3. The detecting device according to claim 2, wherein the swinging lever is in the form of a rocker arm that is connected to the detection circuit and which directs the introduced coin to said path.

* * * * *

UNITED STATES PATENT AND TRADEMARK OFFICE

CERTIFICATE OF CORRECTION

PATENT NO. : 5,402,873

DATED : April 4, 1995

INVENTOR(S) : J. E. Ibarrola et al.

It is certified that error appears in the above-indentified patent and that said Letters Patent is hereby corrected as shown below:

On cover page, item [75] Inventors: subheading, the first inventor's first name should be -- Jesús --; Col. 2, line 19, before "DESCRIPTION" insert -- BRIEF --; Col. 2, line 27, before "DESCRIPTION" insert -- DETAILED --; Col. 2, line 51, "5" should be -- 3 --; Col. 2, line 67, "party" should be -- part, --.

Signed and Sealed this

Eighteenth Day of July, 1995

*Attest:*

Bruce Lehman

BRUCE LEHMAN

*Attesting Officer*

*Commissioner of Patents and Trademarks*